United States Patent [19]

Allegra et al.

[11] 4,350,540

[45] Sep. 21, 1982

[54] METHOD OF PRODUCING AN ALUMINUM-ZINC ALLOY COATED FERROUS PRODUCT TO IMPROVE CORROSION RESISTANCE

[75] Inventors: Louis K. Allegra, Bethlehem; Herbert E. Townsend, Center Valley; Angelo R. Borzillo, Norristown, all of Pa.

[73] Assignee: Bethlehem Steel Corporation, Bethlehem, Pa.

[21] Appl. No.: 267,134

[22] Filed: May 26, 1981

Related U.S. Application Data

[62] Division of Ser. No. 92,787, Nov. 8, 1979, Pat. No. 4,287,009.

[51] Int. Cl.[3] ..... B32B 15/18

[52] U.S. Cl. ..... 148/31.5; 428/635

[58] Field of Search ..... 148/11.5 R, 11.5 Q, 148/12 R, 12 C, 12 D, 31.5, 127, 134; 427/433, 383.9, 320, 321; 428/653; 204/37 R

[56] References Cited

U.S. PATENT DOCUMENTS

| | | | |
|---|---|---|---|
| 3,297,499 | 1/1967 | Mayhew | 148/134 X |
| 3,325,282 | 6/1967 | Mayer et al. | 428/653 X |
| 3,782,909 | 1/1974 | Cleary et al. | 428/653 X |
| 3,860,438 | 1/1975 | Shoemaker | 427/433 |
| 3,884,729 | 5/1975 | Jackson et al. | 427/376.8 X |
| 3,952,120 | 4/1976 | Horton et al. | 427/433 |
| 4,036,600 | 7/1977 | Kimura et al. | 148/31.5 X |

*Primary Examiner*—Peter K. Skiff

*Attorney, Agent, or Firm*—Joseph J. O'Keefe; William B. Noll

[57] ABSTRACT

This invention relates to an aluminum-zinc alloy coated ferrous base product which exhibits improved atmospheric corrosion resistance, and to the process whereby such improved corrosion resistance may be realized. The process is characterized by the steps of heating such coated product to a temperature within the single phase region for the composition corresponding to the aluminum and zinc of said coating, defined as α in the FIGURE in the accompanying drawing, preferably at a temperature between about 650° F. (343° C.) to 750° F. (399° C.), for a period of time to solution treat the aluminum-zinc alloy coating overlay, and cooling slowly to at least 350° F. (177° C.). The resulting product is characterized by improved atmospheric corrosion resistance as a result of the combination of an aluminum-zinc alloy coating overlay having a structure comprised of a fine dispersion of beta-zinc within a matrix of alpha-aluminum, and a thin intermetallic layer interposed between said overlay and said ferrous base.

1 Claim, 4 Drawing Figures

METHOD OF PRODUCING AN ALUMINUM-ZINC ALLOY COATED FERROUS PRODUCT TO IMPROVE CORROSION RESISTANCE

This is a division of application Ser. No. 92,787, filed Nov. 8, 1979, now U.S. Pat. No. 4,287,009.

RELATED APPLICATION

This application is related to U.S. Ser. No. 267,132, filed concurrently herewith, entitled "Method of Improving the Ductility of the Coating of an Aluminum-Zinc Alloy Coated Ferrous Product", and assigned to the assignee of this application.

TECHNICAL FIELD

This invention is directed to the field of metallic coated ferrous products, particularly sheet and strip, where the metallic coating provides barrier and sacrificial type protection to the underlying ferrous base. Preferably this invention relates to continuous steel strip, coated with aluminum-zinc alloy which has been solution treated to improve its corrosion resistance.

BACKGROUND OF THE PRIOR ART

Since the discovery of the use of metallic coatings on ferrous products as a means to deter corrosion of the underlying base, investigators have continuously sought to perfect improvements in coated products to prolong their life or to broaden their scope of application. Such attempts for improvement have followed many avenues. One of the most notable metallic coatings is zinc, exemplified by the widespread use of galvanized steel.

Galvanized steel is produced in a variety of conditions, namely unalloyed, partially alloyed or fully alloyed with the steel base, having a number of different surface finishes. All such varieties and/or finishes were the result of investigators seeking improvements in the coated product.

U.S. Pat. No. 2,110,893 to Sendzimir teaches a continuous galvanizing practice which is still followed today. The Sendzimir practice includes passing a steel strip through a high temperature oxidizing furnace to produce a thin film of oxide coating on the steel strip. The strip is then passed through a second furnace containing a reducing atmosphere which causes a reduction of the oxide coating on the surface of the steel strip and the formation of a tightly adherent impurity-free iron layer on the steel strip. The strip remains in the reducing atmosphere until it is immersed in a molten zinc bath maintained at a temperature of about 850° F. (456° C.). The strip is then air cooled, resulting in a bright spangled surface. The coating is characterized by a thin iron-zinc intermetallic layer between the steel base and a relatively thick overlay of free zinc. The thus coated product is formable, but presents a surface that is not suitable for painting, due to the presence of spangles.

To produce a non-spangled surface which is readily paintable, a process known as galvannealing was developed. The processes described in U.S. Pat. Nos. 3,322,558 to Turner, and 3,056,694 to Mechler are representative of such a process. In the galvannealing process, the zinc coated strip is heated, just subsequent to immersion of the steel strip in the zinc coating bath, to above the melting temperature of zinc, i.e. about 790° F. (421° C.), to accelerate the reaction of zinc with the coating base steel. This results in the growth of the intermetallic layer from the steel base to the surface of the coating. Thus, a characteristic of galvannealed strip is a fully alloyed coating and the absence of spangles.

One area of interest that has garnered the attention of investigators was the need to improve the formability of the coated product. U.S. Pat. Nos. 3,297,499 to Mayhew, 3,111,435 to Graff et al. and 3,028,269 to Beattie et al. are each directed to improving the ductility of the steel base in a continuous galvanized steel. Mayhew's development subjects the galvanized strip to an in-line anneal at temperatures between about 600° to 800° F. (315° to 427° C.) followed by cooling and hot coiling. This treatment is intended to decrease the hardness of the steel base and increase its ductility without causing damage to the metal coating. The Graff and Beattie patents effect the same result with a box anneal treatment at temperatures between about 450° to 850° F. (232° to 455° C.). Finally, the same end result, i.e. improved steel base ductility, in this case for an aluminum clad steel base, is taught by U.S. Pat. No. 2,965,963 to Batz et al. The Batz et al. patent teaches heating an aluminum clad steel at temperatures in the range of 700° to 1070° F. (371° to 577° C.). Characteristic features of the processes of each of the preceding patents directed to post annealing of the coated product is to effect changes in the base steel without any recognizable metallurgical effect on the coating itself or on any improvements thereof.

The search for improved metallic coated products has not been limited to investigations of existing products. This was evidenced by the introduction of a new family of coated products, namely aluminum-zinc alloy coated steel, described, for example, in U.S. Pat. Nos. 3,343,930 to Borzillo et al., 3,393,089 to Borzillo et al., 3,782,909 to Cleary et al., and 4,053,663 to Caldwell et al. The inventions described in such patents, directed to aluminum-zinc alloy coated steel, represented a dramatic departure from past materials and practices, as the aluminum-zinc alloy coating is characterized by an intermetallic layer and an overlay having a two-phase rather than a single phase structure. Specifically, examination of the coating overlay revealed a matrix of cored aluminum-rich dendrites and zinc-rich interdendritic constituents. The resistance to corrosive media by the aluminum-zinc alloy coating, and hence the maintenance of the integrity of the underlying steel base, is the result of the unique interaction or combination of the intermetallic layer with the aluminum-rich matrix and the zinc-rich interdendritic constituents. The present invention, as disclosed by these specifications, evolved as a result of the desire to effect a change in the relationship of the intermetallic layer, the aluminum-rich matrix, and the zinc-rich interdendritic constituents, to improve the properties of an aluminum-zinc alloy coated ferrous product even more.

SUMMARY OF THE INVENTION

This invention is directed to an aluminum-zinc alloy coated ferrous product having improved atmospheric corrosion resistance, and to the process whereby such improved corrosion resistance may be realized. More particularly this invention relates to a ferrous strip coated with an aluminum-zinc alloy which has been subjected to solution treatment, preferably at temperatures between about 650° F. (343° C.) to about 750° F. (399° C.), for a period of time sufficient to cause dissolution of the zinc-rich interdendritic constituents, and slowly cooled to at least 350° F. (172° C.) to develop a coating structure comprising a fine dispersion of zinc-rich phases (beta-zinc) within an aluminum-rich matrix (alpha-aluminum).

DETAILED DESCRIPTION OF INVENTION

Figure 1:
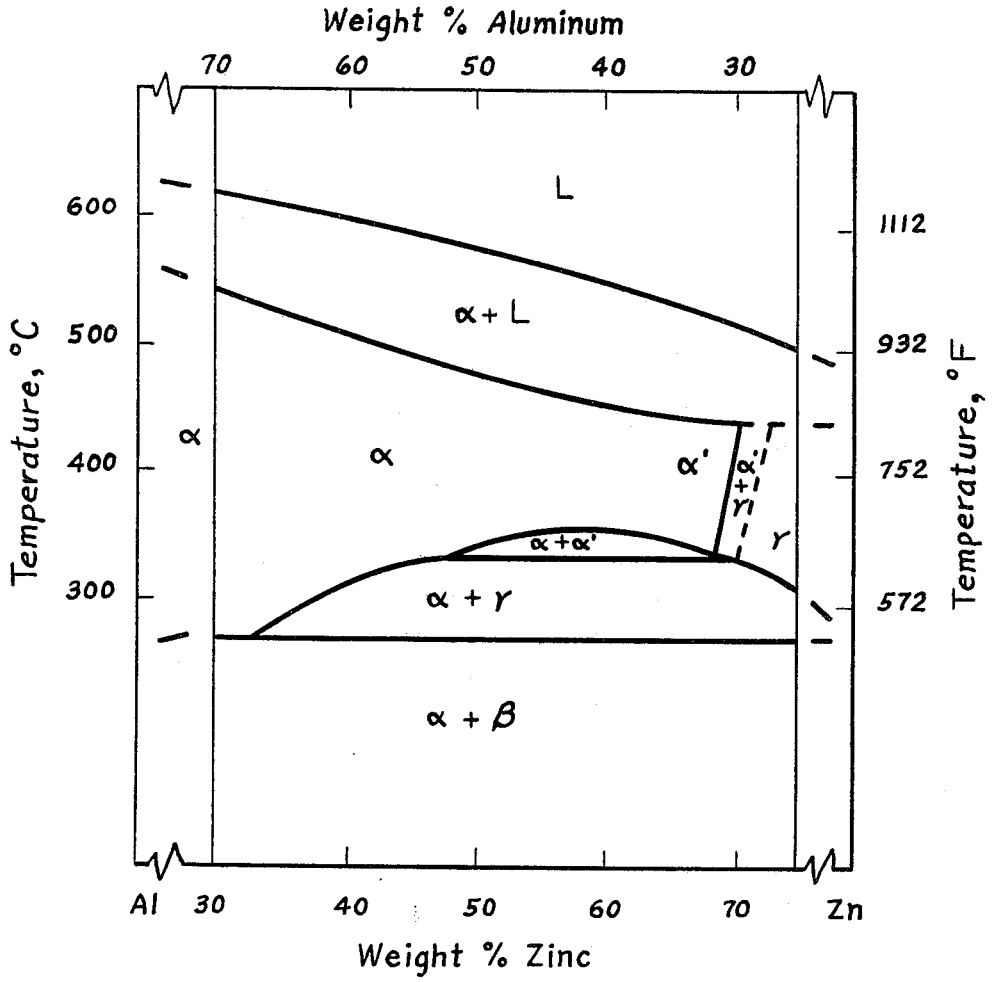
FIG. 1 is a partial phase diagram for aluminum-zinc binary alloys showing the range of heating temperatures (single phase α region) for practicing this invention.

This invention relates to an aluminum-zinc alloy coated ferrous product, such as produced by continuous hot-dip coating of a steel strip, where such product's corrosion resistance behavior in the atmosphere is enhanced through a solution treatment of the alloy coating. In order to appreciate the contributions of this invention it may be helpful to review the mechanism and morphology of the atmospheric corrosion process of aluminum-zinc alloy coated steel. By aluminum-zinc alloy coatings we intend to include those coatings covered by U.S. Pat. Nos. 3,343,930; 3,393,089; 3,782,909; and 4,053,663, each of which patents was noted previously. These aluminum-zinc alloy coatings comprise 25% to 70%, by weight aluminum, silicon in an amount of at least 0.5% by weight of the aluminum content, with the balance essentially zinc. Among the many coating combinations available within these ranges, an optimum coating composition for most uses is one consisting of approximately 55% aluminum, about 1.6% silicon, with the balance zinc, hereinafter referred to as 55 Al-Zn.

Examination of a 55 Al-Zn coating reveals an overlay having a matrix of cored aluminum-rich dendrites with zinc-rich interdendritic constituents and an underlying intermetallic layer. Such a coating offers many of the advantages of the essentially single phase coatings such as zinc (galvanized) and aluminum (aluminized) without the disadvantages associated with such single phase coatings. To study the atmospheric corrosion behavior of the 55 Al-Zn coatings an accelerated laboratory study was conducted to simulate such behavior.

The time dependence of the corrosion potential for 55 Al-Zn coatings exposed to laboratory chloride or sulfate solutions reflects two distinct levels or stages. Subsequent to first immersion the coating exhibits a corrosion potential close to that of a zinc coating exposed under identical conditions. During this first stage the zinc-rich portion of the coating is consumed, the exact time depending on the thickness of the coating (mass of available zinc) and the severity of the environment (rate of zinc corrosion). Following depletion of the zinc-rich fraction, the corrosion potential rises and approaches that of an aluminum coating. During this second stage the coating behaves like an aluminum coating, passive in sulfate environments, but anodic to steel in chloride environments. The behavior of the 55 Al-Zn coating during atmospheric exposure appears to proceed in a manner analogous to that observed in these laboratory solutions, although the time scale is greatly extended. The zinc-rich interdendritic portion of the coating corrodes preferentially. During this period of preferential zinc corrosion the coating is sacrificial to steel, and the cut edges of thin steel sheet are galvanically protected. The initial overall rate of corrosion of the 55 Al-Zn coating is less than that of a galvanized coating because of the relatively small area of exposed zinc.

As the zinc-rich portion of the coating becomes gradually corroded, the interdendritic interstices or voids are filled with zinc and aluminum corrosion products. The coating is thus transformed into a composite comprised of an aluminum-rich matrix with zinc and aluminum corrosion products mechanically keyed into the interdendritic labyrinth. The zinc and aluminum corrosion products offer continued protection as a physical barrier to the transport of corrodents to the underlying steel base.

The as-cast structure of an aluminum-zinc alloy coating, produced by the accelerated cooling practice of U.S. Pat. No. 3,782,909, is a fine, non-equilibrium structure having cored aluminum-rich dendrites and zinc-rich interdendritic constituents. The practice of the present invention modifies the as-cast structure obtained by the process of U.S. Pat. No. 3,782,909 to produce a fine dispersion of beta-Zn within a matrix of alpha-Al. This may be clarified by reference to FIG. 1. FIG. 1 is a partial equilibrium phase diagram of the aluminum-zinc system. The aluminum-rich end of the diagram is characterized by a broad single-phase alpha region designated as α. It has been discovered that heating the as-cast aluminum-zinc coated steel to a temperature within the alpha region causes a dissolution of the interdendritic zinc-rich constituents, and if followed by slow cooling, i.e. furnace cooling, results in such fine dispersion of beta-zinc precipitates. In contrast to the as-cast structure, the zinc-rich phase within the solution treated structure is no longer continuous from the coating surface to the underlying intermetallic layer. By this solution treatment the atmospheric corrosion behavior of the aluminum-zinc alloy coated steel is altered. In a comparison of the atmospheric corrosion rate in a rural exposure of a 55 Al-Zn (as-cast) coated steel with a 55 Al-Zn coated steel treated according to this invention a 20% decrease in weight loss of the coating treated according to this invention was noted after 5½ years exposure at a rural test site.

Figure 2:
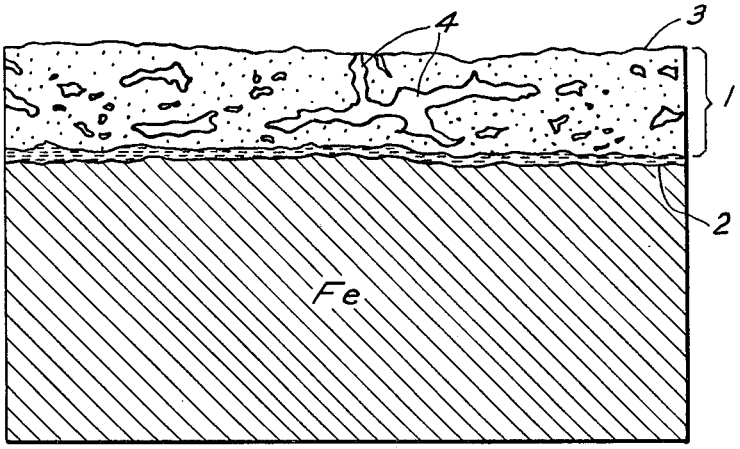
FIG. 2 is a drawing of a photomicrograph of a cross-section, at 1000X, of an as-cast cold rolled aluminum-zinc alloy coated steel sheet after exposure in an industrial environment for twenty two months.
Figure 3:
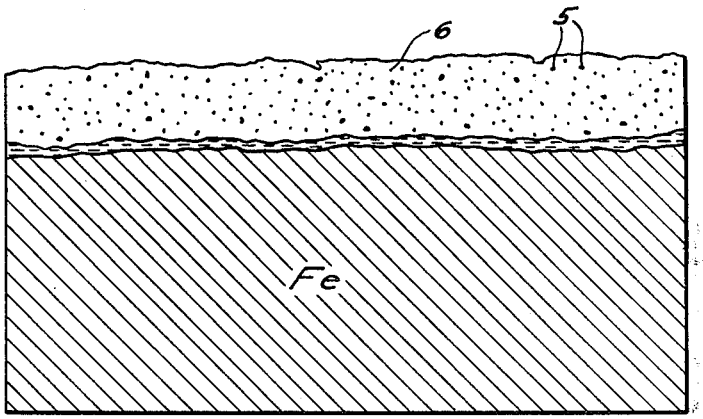
FIG. 3 is a drawing of a photomicrograph of a cross-section, at 1000X, of a cold rolled aluminum-zinc alloy coated steel sheet, solution treated according to the present invention, after exposure in an industrial environment for twenty two months.

As-cast aluminum-zinc alloy coated steel may be subjected to a cold rolling step subsequent to coating. A commercial product, one reduced by about one-third, is characterized by a tensile strength in excess of 80 ksi, up from about 45–50 ksi, and a smooth spangle-free coating. During cold rolling the coating is reduced in thickness and the intermetallic layer develops fine cracks. Though the solution treatment of this invention does not heal the fine cracks in the intermetallic layer, it has been discovered that such treatment removes the easy corrosion path to the intermetallic layer by eliminating the zinc-rich network structure. This feature is illustrated by the comparison of FIG. 2 with FIG. 3. FIG. 2 is a representation of a photomicrograph (1000X) of an as-cast, cold-rolled, 55 Al-Zn coated steel taken of a specimen exposed in an industrial environment for twenty-two months. The coating 1 consists of a thin intermetallic layer 2 and an overlay 3. The overlay 3 is characterized by a network of voids 4, formerly zinc-rich interdendritic constituents, which are the result of the preferential corrosion of such zinc-rich interdendritic constituents. This easy corrosion path to the intermetallic layer has been eliminated by the solution treatment of this invention, as illustrated in FIG. 3. Such figure is similar to FIG. 2 except that the specimen is from a coated, cold-rolled steel sheet solution treated at 750° F. (399° C.) for sixteen hours and furnace cooled prior to exposure. The solution treatment, as described by the present invention, resulted in the dissolution of the zinc-rich interdendritic constituents to reveal an aluminum-zinc alloy coating structure comprised a fine dispersion of zinc-rich phases 5 (shown as specks in FIG. 3) within an aluminum-rich matrix 6. An alternative, but nevertheless effective way to improve corrosion resistance in a cold rolled coated product, is to subject the as-cast, solution treated aluminum-zinc alloy coated product to a cross-section reduction step, i.e. shift the reduction step from before to after the solution treatment.

From a review of FIG. 1 it is apparent that the range of heating temperatures will vary depending upon the composition of the aluminum-zinc alloy coating. The optimum temperature for 55 Al-Zn is above about 650° F. (343° C.), and preferably within the range of about 650° F. (343° C.) to about 750° F. (399° C.). The hold time at such temperatures is relatively short. While normally only several minutes at temperature is needed to cause dissolution of the interdendritic zinc-rich constituents, times of twenty four hours are not detrimental to achieving the desired results. In order to precipitate zinc from the supersaturated solid solution, which may cause age hardening, a cooling rate through the two phase (alpha+beta) region should not exceed about 150° F./min (83° C./min) down to a temperature of at least 350° F. (177° C.).

Figure 4:
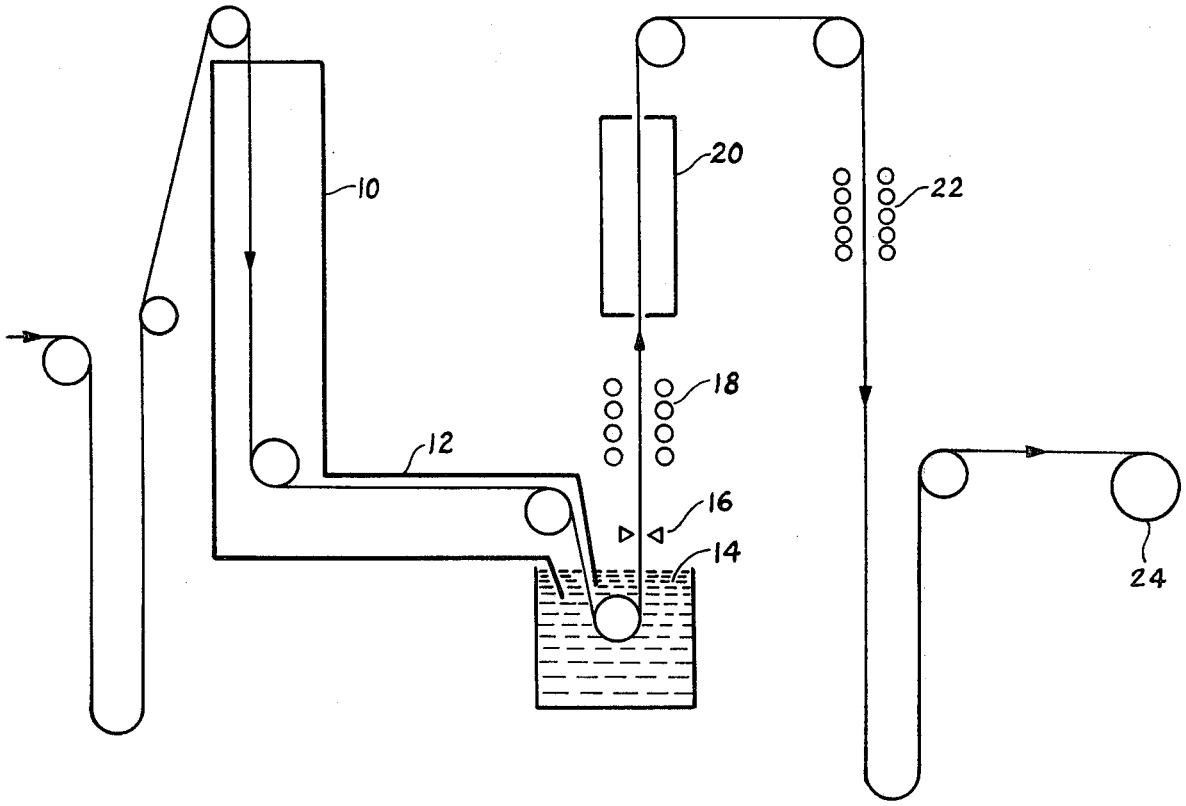
FIG. 4 is a schematic representation of a continuous hot-dip coating line incorporating solution treating means to practice the present invention.

The preceding discussion has treated the solution treatment step of this invention in terms of a batch treatment. That is, such bath treatment occurs at a point in time subsequent to coating, i.e. immersion of the strip in a molten aluminum-zinc alloy coating bath, and coating solidification and cooling to ambient temperature. However, since the minimum time at the solution treatment temperature is relatively short, an in-line or continuous treatment may be used. This aspect of the invention will be appreciated by first considering and understanding the commercial practice for producing aluminum-zinc alloy coated steel. Such practice is covered by U.S. Pat. No. 3,782,909. The practice of U.S. Pat. No. 3,782,909, as modified by the teachings of the present invention, is illustrated schematically in FIG. 4. This modified practice includes the steps of preparing a steel strip substrate for the reception of a molten aluminum-zinc alloy coating by heating to a temperature of about 1275° F. (690° C.) in a furnace 10, followed by maintaining said steel strip under reducing conditions (holding and cooling zone 12) prior to coating. As the strip leaves zone 12, it is immediately immersed in a molten coating bath 14 of aluminum-zinc alloy. After emerging from coating bath 14 the strip passes between coating weight control dies 16 and into an accelerated cooling zone 18 where the aluminum-zinc alloy coating is cooled during substantially the entire solidification of said coating at a rate of at least 20° F./sec. (11° C./sec.). For a 55 Al-Zn coating, the temperature range of accelerated cooling is about 1100° F. (593° C.) to about 700° F. (371° C.). Upon reaching the temperature of full solidification, or just beyond full solidification to insure against residual heat within the steel base reheating the coating above said solidification range, the cooling rate of the solidified coating and steel base is arrested. That is, such coated steel base is subjected to a solution treatment furnace 20 where the coated product is maintained at a temperature within the $\alpha$ temperature range, typically about 700° F. (371° C.) to 650° F. (343° C.) for sufficient time to allow solution treatment of the aluminum-zinc alloy coating in the manner described above. Following solution treatment of the coating the coated strip is slowly cooled to at least 350° F. (177° C.) such as by air cooling 22, and coiled 24. This continuous or in-line treatment has the obvious advantage of eliminating the previously noted batch treatment.

We claim:

1. A thermally-treated metallic coated ferrous base product having improved atmospheric corrosion resistance, characterized by a solution treated coating overlay comprised of an aluminum-zinc alloy consisting essentially of by weight 25 to 70% aluminum; a small addition of silicon and the balance zinc and a thin intermetallic layer interposed between said overlay and said ferrous base, whereby the structure of said overlay consists of a fine dispersion of zinc within an aluminum-rich matrix.

* * * * *